United States Patent [19]

Kaeslin et al.

[11] Patent Number: 4,493,423

[45] Date of Patent: Jan. 15, 1985

[54] CORNERING DEVICE FOR A GARMENT SUPPORT STRUCTURE

[76] Inventors: Oscar E. Kaeslin, 1444 SW. 27th Ct., Fort Lauderdale, Fla. 33315; Monroe H. Schenker, 7622 Sierra Dr. West, Boca Raton, Fla. 33433

[21] Appl. No.: 478,363

[22] Filed: Mar. 24, 1983

[51] Int. Cl.[3] ..... A47K 10/04

[52] U.S. Cl. ..... 211/123; 211/86; 211/105.1; 211/182; 108/29; 108/31

[58] Field of Search ..... 211/123, 86, 105.1, 211/105.2, 105.4, 117, 182; 108/29, 31

[56] References Cited

U.S. PATENT DOCUMENTS

| | | | |
|---|---|---|---|
| 1,207,369 | 12/1916 | Casey | 211/105.1 X |
| 2,478,337 | 8/1949 | Strasser et al. | 211/123 X |
| 2,828,864 | 3/1958 | Evans | 211/86 |
| 4,125,078 | 11/1978 | Nyquist | 108/29 |
| 4,285,484 | 8/1981 | Follows | 108/29 X |
| 4,361,099 | 11/1982 | Kokenge | 211/182 X |

FOREIGN PATENT DOCUMENTS

| | | | |
|---|---|---|---|
| 210164 | 8/1955 | Australia | 211/123 |
| 26050 | of 1898 | United Kingdom | 211/123 |

*Primary Examiner*—Ramon S. Britts
*Assistant Examiner*—Blair M. Johnson
*Attorney, Agent, or Firm*—M. K. Silverman

[57] ABSTRACT

There is disclosed a cornering device for a garment support structure which includes first and second horizontal transverse assemblies. The cornering device includes first and second horizontal support elements, each having a first and second end. Also included is hardware for suspending the first ends of both elongate horizontal elements from their corresponding transverse assembly and parallel thereto, such that the second ends of both elongate support elements comprise an acute angle. Further included are means for mutually securing both second ends of the elongate elements and, concurrently, suspending both second ends at vertical offset in a desired plane beneath the plane of said transverse assemblies.

4 Claims, 9 Drawing Figures

FIG. 1
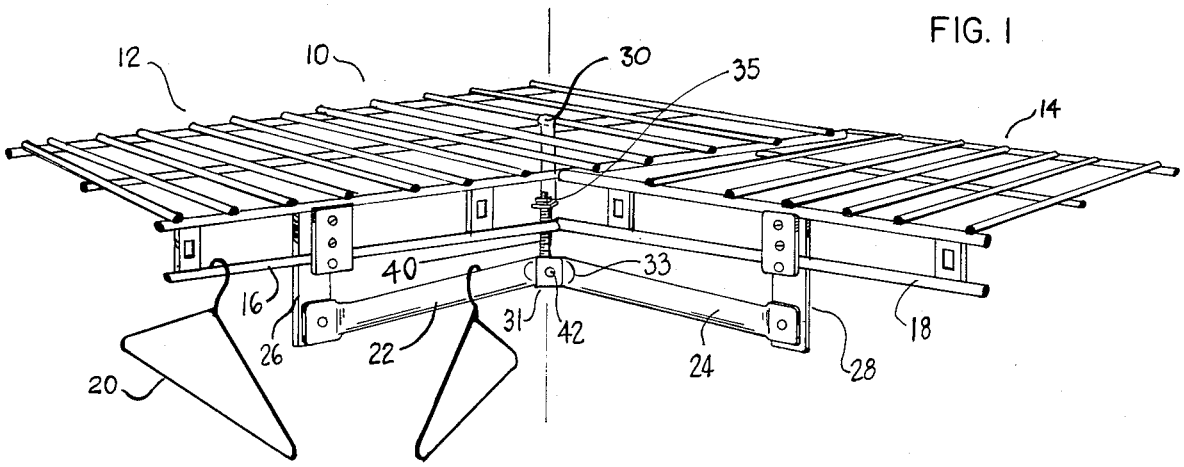
FIG. 2
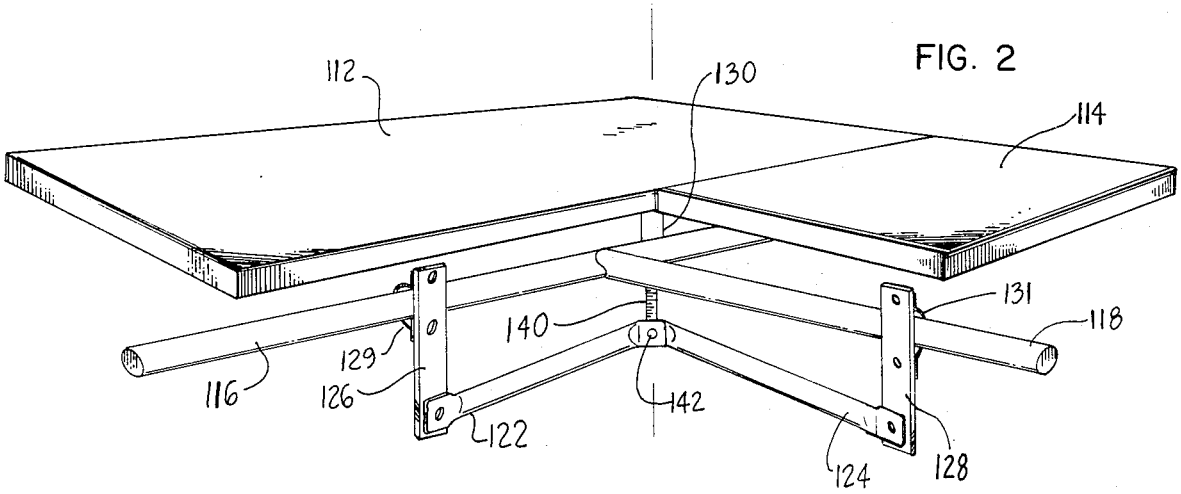
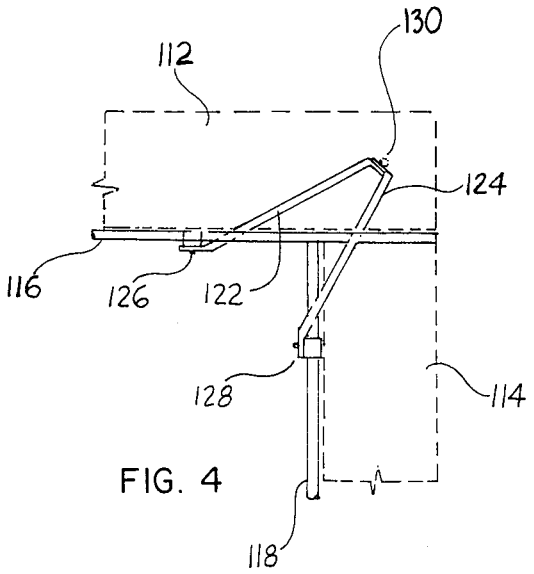
FIG. 4
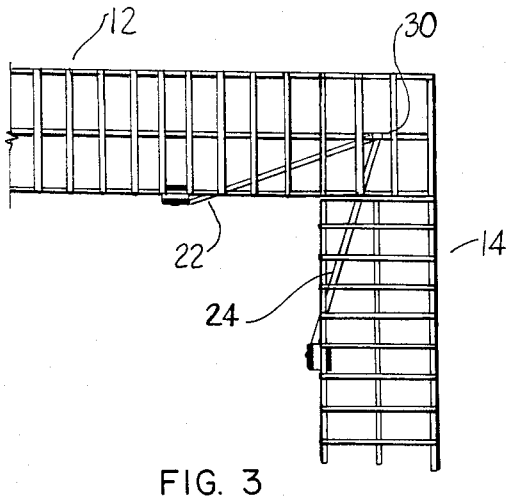
FIG. 3

CORNERING DEVICE FOR A GARMENT SUPPORT STRUCTURE

BACKGROUND OF THE INVENTION

The present invention relates to a cornering device which may be used with various garment support structures wherein such structures include transverse shelving or poles, typically defining a right angle at the corner of a closet or storage area.

The need for an invention of the instant character derives from the long-standing effort to render more accessible closet and storage areas. More particularly, the present invention is intended to increase both the accessibility and the effective hanging space of a storage area for garments that are hung upon conventional triangular hangers, blouse hangers, suit hangers, trouser hangers, or any other such hanging means, in which the clothes are intended to hang vertically.

One problem which exists by virtue of the geometry of many closets and storage areas is that the corners thereof represent areas which cannot be easily accessed where one fills such spaces with vertical garment hangers and garments. Accordingly, the present invention can be viewed as an effort to solve this particular space-use problem in order to maximize the corner accessibility and capacity of certain garment support structures that are disposed in the corner of closets or storage areas.

The present technology is believed to be properly classified in U. S. Class 211, Sub-classes 105.1 and 123. The most pertinent examples of the prior art known to the inventors are U.S. Pat. Nos. 2,805,708 to Brennan and 3,456,807 to D'Anato, as well as Australian Pat. No. 210,164. None of these patents are believed to suggest the subject matter of the Applicant's invention.

SUMMARY OF THE INVENTION

The invention shown herein constitutes a cornering device for a garment support structure in which the support structures includes first and second horizontal transverse assemblies as, for example, a shelving and pole system within a garment storage closet. The cornering device specifically includes a first elongate horizontal support element having a first end and a second end; a second elongate horizontal support element having a first end and a second end; means for suspending the first end of said first elongate horizontal element from said transverse assembly; means for suspending said first end of said second elongate horizontal element from said second transverse assembly, such that the second ends of both the first and second elongate elements are capable of intersection; and means for mutually securing said second ends of said elongate support elements and concurrently suspending said second ends at a vertical offset and in a desired parallel plane beneath the plane of said transverse assemblies, in which said elongate elements will thereby define a plane parallel to the plane of said transverse assemblies and at a distance therebelow which is defined by said vertical offset. In the above structure, the horizontal elongate support elements will intersect at an acute angle which will effectively increase the linear hanging capability and garment accessibility of both elongate support elements.

BRIEF DESCRIPTION OF THE DRAWINGS

FIG. 1 is a perspective view of one embodiment of the present invention adapted for use in association with a first form of the garment support structure.

FIG. 2 is a perspective view of a second embodiment of the present invention adapted for use with a second form of garment support structure.

FIG. 3 is a top schematic view of the first embodiment of the invention.

FIG. 4 is a top schematic view of the second embodiment of the invention.

DETAILED DESCRIPTION OF THE INVENTION

Figure 8:
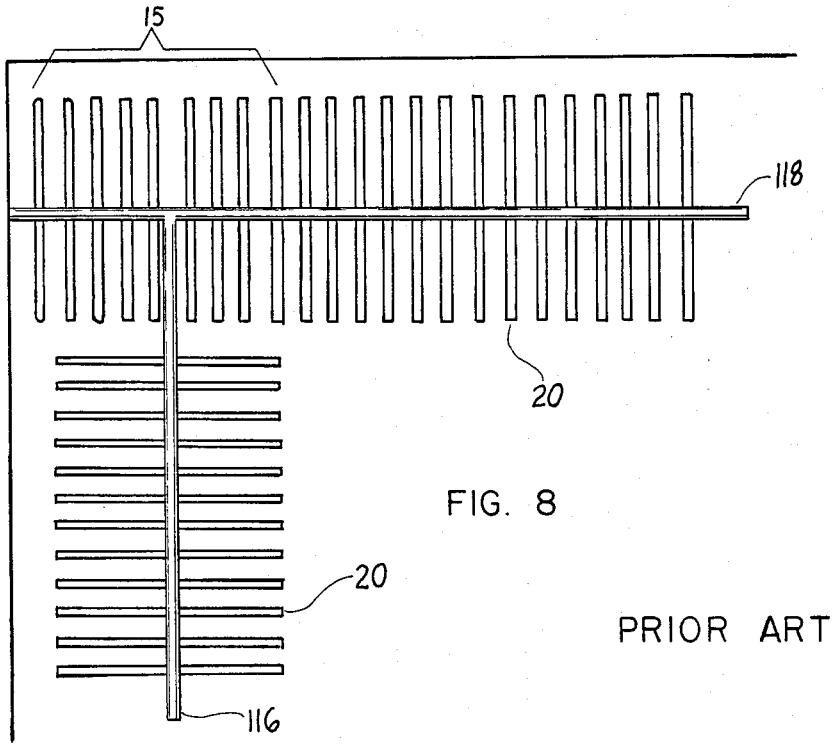
FIG. 8 PRIOR ART
FIG. 8 is a diagrammatic view of a prior art hanger and horizontal support assembly.

There is illustrated in FIG. 8 a diagrammatic view of a typical arrangement of hangers 20 and poles 116 and 118 as has existed in the prior art. As may be noted, in this arrangement, the first number of hangers and garments 15 from the left on pole 116 are effectively hidden from view and, practically speaking, are inaccessible to the user. It is as a solution to this "packing-in" problem that the hereinafter set forth Description of the Invention is to be viewed.

A first embodiment of the invention is defined with reference to FIGS. 1, 3, 5, 6, and 7. More particularly, there is shown in FIG. 1 a garment support structure 10 which includes a first horizontal transverse assembly 12 and a second horizontal assembly 14. As may be noted in FIG. 1, the assemblies 12 and 14 are disposed along walls that are at right angles with each other; accordingly, the longitudinal axis of the respective assemblies 12 and 14 are also at right angles with each other, ergo, the terminology "transverse" assemblies. Additionally, each transverse assembly is provided with a horizontal hanging rod 16 (for assembly 12) and 18 (for assembly 14). As may be noted, the transverse horizontal assembly serves essentially two purposes: namely, support of vertically hung garments which are first hung upon hangers 20 or other such hanging means having a hook or loop which can engage rod 16 or 18. Also, the transverse assemblies provide a storage area in which the horizontal surface defined by the top of the transverse assemblies can be used as a base upon which items can be stored. Also shown in FIG. 1 is a first elongate horizontal support element 22 and a second elongate horizontal support 24. These elements are suspended from the transverse horizontal assemblies 12 and 14 by a first suspension means 26 and a second suspension means 28. The suspension of the elongate horizontal elements 26 and 28 is also achieved through the use of a vertical bracket 30 and eyebolt 40 which act as a means of mutually securing the second ends 31 and 33 of the horizontal elongate elements 22 and 24 at a vertical offset beneath the plane of said transverse assemblies. Through this arrangement, the combined length of (a) the suspension means 26 (or 28) and (b) the vertical bracket 30 and its eyebolt 40, define a plane parallel to the plane of said transverse assemblies 12 and 14. It is also noted that this combined length may be varied by the adjustment of nut 35.

Figure 9:
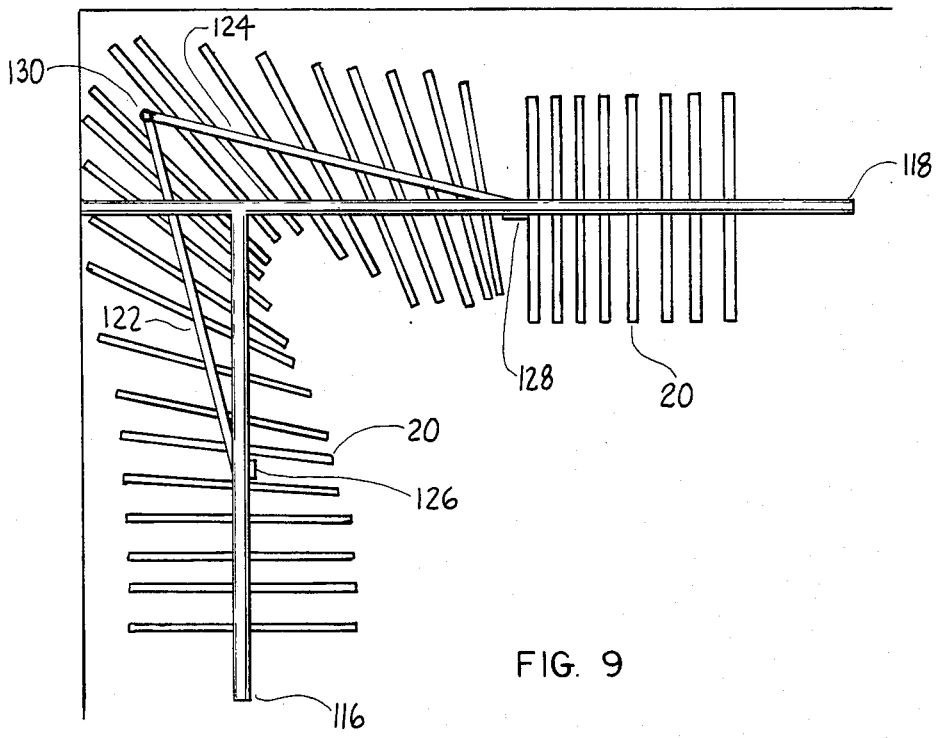
FIG. 9 is a diagrammatic view of the hanger and horizontal support assembly of the present invention.

The above arrangement is shown in top view in FIG. 3 wherein it may be appreciated that the position of the vertical bracket 30 creates an acute angle between the elongate elements 22 and 24. It is to be further appreciated that the acute angle between the elongate elements 22 and 24 increases the effectively available linear hanging footage of the garment support structure as against that which would be available were it not for the present inventive cornering device. More particularly, from FIG. 9 it can be seen that articles of clothing on a hanger can be aligned with each other in order to completely and closely fill the space between and about the elongate elements while, however, affording improved visibility and accessibility to the clothing on the hangers 20. It has been determined that the amount of clothing that can be stored by this arrangement will exceed by at least forty percent, the storage capability that would exist were either rod 16 or 18 permitted to extend completely across to the wall and orthogonal to either of opposite rods 18 or 16 respectively.

Figure 5:
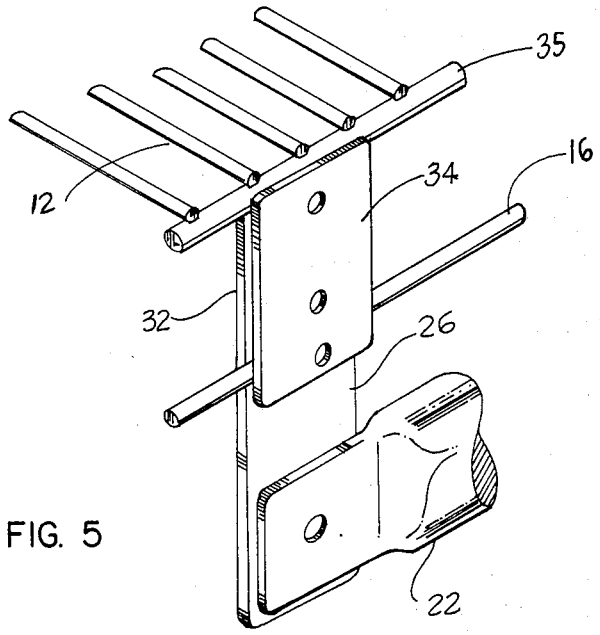
FIG. 5 is a perspective view of a bracket used in the first embodiment for suspension of one end of an elongate horizontal element beneath one of the transverse assemblies.
Figure 6:
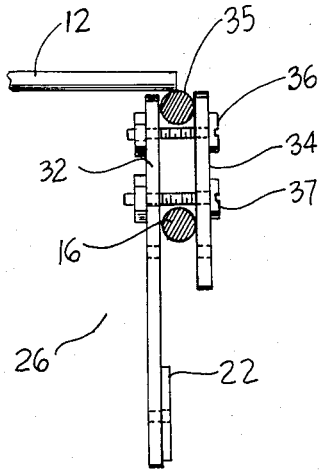
FIG. 6 is a side cross-sectional schematic view of the bracket of FIG. 5.

With further reference to the suspension bracket 26 (which is identical to suspension bracket 28), FIGS. 5 and 6 illustrate one embodiment of such bracket that has been found to be suitable for usage with garment support structures of the type shown in FIG. 1. More particularly, it has been found that use of two strips of metal including a longer piece 32 and a narrower piece 34, disposed at opposite sides of the rod 16 and rod 35 are suitable to mutually secure elements 32 and 34 by bolt means 36 and 37, and permit adequate clearance for the hooks of the hangers 20 disposed on the elongate elements 22 and 24. Also shown in FIG. 6 is a cross-section of the connection between elongate elements 22 and longer piece 32.

Figure 7:
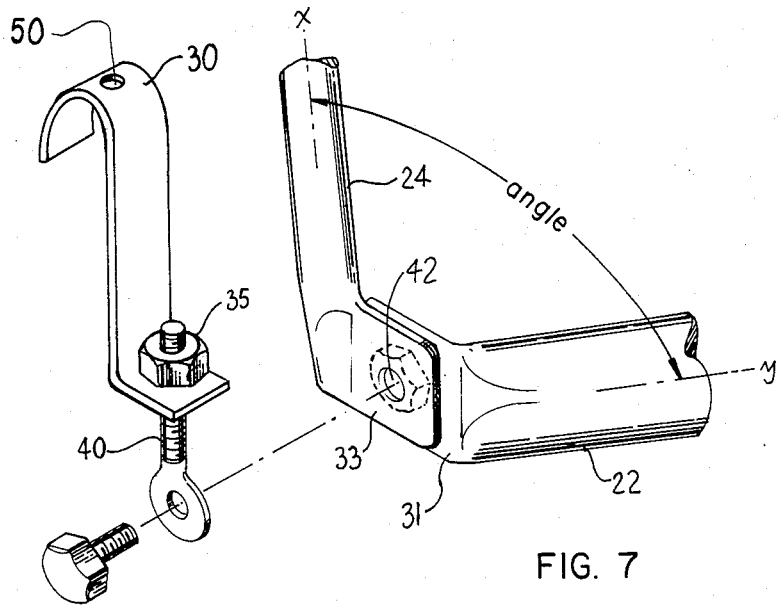
FIG. 7 is an exploded view of the bracket and adjustable nut used for the mutual securement of the intersecting ends of the elongate support elements and for the suspension of said intersection in the plane of the transverse assemblies, and said intersecting ends of the elongate support elements.

Shown in FIG. 7 is vertical support bracket 30, its associated eyebolt 40 and adjustment nut 35. Also shown in conjunction with the vertical elements is the intersection 31 and 33 of the elongate horizontal elements 22 and 24. This is a rear view of the intersection in which the corner of the closet or storage area is in the direction of the vertical support elements 30 and 40. It is to be understood that, in combination, the vertical hook-like element 30 and eyebolt 40 comprise means for mutually securing one set of ends of the elongate support elements 22 and 24 at a vertical offset beneath the plane of the transverse assemblies 12 and 14. The vertical offset is defined by the sum of the effective vertical lengths of the elements 30 and 40. Through such vertical offset of the elongate elements 22 and 24, said elements define a plane which is parallel to the plane of the transverse assemblies at a distance therebelow which is also established by said vertical offset created by elements 30 and 40. With further reference to FIG. 7, it is of course noted that a hole 42 is secured to the eye of the eyebolt 40, as by a nut and bolt arrangement shown partially in phantom in FIG. 7.

A second embodiment of the invention is shown in FIGS. 2 and 4. Therein, it is noted that in lieu of the heavy wire-like structures of the embodiments in FIG. 1, the transverse horizontal assemblies exist in the form of conventional shelves 112 and 114, and a corresponding pair of poles 116 and 118. In this embodiment are vertical brackets 130 and 140 which function analogously to elements 30 and 40 as described above. Also, in the embodiment of FIG. 2, suspension brackets 126 and 128 differ slightly from the design of brackets 26 and 28 in FIG. 1 in that loop-like elements 129 and 131 are provided in lieu of the element 34 in the first embodiment. The second embodiment uses elongate horizontal support elements 122 and 124 which are identical to the horizontal support elements 22 and 24 of the embodiment of FIG. 1. It is noted that hole 50 in brackets 30 and 130 is employed only in the second embodiment, this being to secure such brackets to the horizontal shelf 112.

In the invention as above described, it is to be understood that elongate elements 22 and 24 may be provided as a single integral piece having an acute angle therein. The same is true of elements 122 and 124.

It is to be understood that both described embodiments of the present invention are simply illustrative and that other designs may be readily devised by those skilled in the art, and that such designs will embody the principles of this invention and, therefore, are to be included within the scope and spirit of this specification and appended claims.

Having thus described our invention, what we claim as new, useful and non-obvious and, accordingly, secure by Letters Patent of the United States is:

1. A cornering device for a garment support structure, the garment support structure including first and second horizontal transverse assemblies, said horizontal transverse assemblies including planer shelving elements and pole elements, each pole element associated with a corresponding shelving element, the shelving elements and their respective pole elements having a mutual intersection near the corner of the walls to which said shelving and pole elements are normally secured, in which the present inventive cornering device comprises:

(a) first and second elongate rod elements having respective first and second ends;

(b) means for suspending the first end of each of said first and second elongate rod elements at a fixed distance from and beneath the poles of said garment support structure; and (c) means for mutually securing said second ends of both elongate rod elements at substantially the line of intersection between said first and second transverse assemblies, said securing means including means for securing said second ends of said rods at a vertical offset beneath said shelves in a desired parallel plane beneath the plane of said shelving, said offset corresponding, in terms of said plane, to the offset at which said first ends are secured beneath the poles of said garment support structure, said securing means further comprising means for defining an intersection of said first and second rod elements at an included acute angle in the range of 15° to 75°, whereby said rod elements will, at three points mutually defining a triangle, connect to the poles and shelves of the garment support structure to thereby define a plane parallel to the plane of said poles and shelving and at a distance therebelow defined by each of the three vertical offsets existing between the cornering device and the garment support structure and, further whereby, said acute angle of intersection of the first and second rod elements will enhance the ease of accessibility of garments hung in a corner area and will increase the number of garments that can, without sacrifice of accessibility, be supported within a corner area of the garment support structure.

2. The cornering device as recited in claim 1 in which said mutual securing means comprises, in combination, an assembly having means for adjustment of the verticle position thereof.

3. The cornering device as recited in claim 2 in which said assembly comprises, in combination, a vertical support bracket, an eyebolt, and an associated nut for the adjustable-length securement of said bracket to said eyebolt.

4. The cornering device as recited in claim 1 in which said first and second elongate horizontal support elements jointly comprise a single integral piece having an acute angle near the center thereof.

* * * * *